United States Patent [19]

Zegers et al.

[11] 4,188,564

[45] Feb. 12, 1980

[54] CATHODE RAY TUBE HAVING LOW RESISTANCE CONTACT AREA BENEATH HIGH VOLTAGE CONTACT SPRING

[75] Inventors: Antonius P. F. Zegers; Johannes M. A. A. Compen, both of Eindhoven, Netherlands

[73] Assignee: U.S. Philips Corporation, New York, N.Y.

[21] Appl. No.: 910,081

[22] Filed: May 26, 1978

Related U.S. Application Data

[63] Continuation of Ser. No. 764,347, Jan. 31, 1977, abandoned.

[30] Foreign Application Priority Data

Dec. 13, 1976 [NL] Netherlands ..... 7613806

[51] Int. Cl.[2] ..... H01J 29/07; H01J 29/00

[52] U.S. Cl. ..... 313/479; 313/477 HC

[58] Field of Search ..... 313/402, 404, 406, 407, 313/479, 764, 347

[56] References Cited

U.S. PATENT DOCUMENTS

| | | | |
|---|---|---|---|
| 3,621,318 | 11/1971 | Lewinson | 313/406 X |
| 3,639,797 | 2/1972 | Fukushima et al. | 313/450 |
| 3,791,546 | 2/1974 | Maley et al. | 313/479 X |
| 4,092,444 | 5/1978 | Kilichowski | 313/479 X |

FOREIGN PATENT DOCUMENTS

| | | | |
|---|---|---|---|
| 2232798 | 1/1973 | Fed. Rep. of Germany | 313/479 |
| 1226728 | 3/1971 | United Kingdom | 313/481 |

*Primary Examiner*—Robert Segal
*Attorney, Agent, or Firm*—Algy Tamoshunas

[57] ABSTRACT

A color television display tube having color selection means connected electrically by at least one metal contact spring to a resistive layer provided on the inner surface of the envelope of the tube. A low resistance contact face is applied on the resistive layer between the spring and the layer to reduce the contact resistance therebetween, thereby reducing undesirable interference radiation transmitted by the tube.

5 Claims, 3 Drawing Figures

CATHODE RAY TUBE HAVING LOW RESISTANCE CONTACT AREA BENEATH HIGH VOLTAGE CONTACT SPRING

This is a continuation of application Ser. No. 764,347, filed Jan. 31, 1977, now abandoned.

The invention relates to a color television display tube comprising in an evacuated envelope an electrode system for generating at least two electron beams and a display screen having a large number of regions luminescing in different colors and provided on an internal wall part of the envelope forming the display window. The display tube further includes an electrical resistive layer on an internal wall part of the envelope situated between the electrode system and the display screen, and color selection means having a large number of apertures which assign each electron beam to luminescent regions of one color. The color selection means is situated in the tube at a defined distance from the display screen and is connected electrically to the resistive layer by at least one metal contact spring which presses against the part of the wall of the tube provided with the resistive layer.

For generating an electron beam in a picture display tube, the electrodes of the electrode systems mounted in the tube for that purpose are often operated at very different voltages. Voltage differences of 20 kV between electrodes situated at short distance from each other are quite usual, particularly in display tubes for displaying color pictures. With such voltage differences, electrical flash-overs may occur between the electrodes and, when no special measures are taken, may be associated with currents rising very rapidly in time and reaching values of 500 A and higher. Via inductive or capacitive couplings, such currents may seriously damage certain components, in particular semiconductor components, in the electronic circuit of the television receiver, as well as the electrode system itself.

British Patent Specification No. 1,226,728 discloses a television display tube, which, in order to restrict the detrimental results of such an electrical flash-over, has a resistive layer provided on an internal wall part of the tube envelope. Although such a resistive layers affords protection against damage to the electronic circuit television receiver, it presents some other problems. Notably, problems occur due to the fact that a switched-on television receiver may be a source of interference for a radio receiver placed in the proximity thereof and tuned to a transmitter in the long or medium waveband. This interference is caused largely by the video signal. During operation of the display tube, the display screen is scanned with electron beams modulated in accordance with the video signal. Part of said beams reaches the display screen via the apertures in the color selection means, while the part of the beams which does not pass through, impinges upon the color selection means itself. As a result, the electrical potential of the color selection means and the display screen fluctuates in accordance with the amplitude of the video signal and the fluctuations are transmitted as interference radiation by the display screen.

It is the object of the invention to provide a color television display tube having an internal resistive layer, in which measures are taken to reduce the above-mentioned interference radiation.

For that purpose, a color television display tube according to the invention, having a color selection means connected electrically to the internal resistive layer by means of at least one metal contact spring which presses against the wall part of the tube provided with the resistive layer, is characterized in that the contact spring is connected electrically to the resistive layer via a contact face provided on the resistive layer and consisting of a material having an electrical conductivity which exceeds that of the material of the resistive layer.

The invention is based on the recognition from experiments that the interference radiation transmitted by the tube decreases in the resistance of the electrical connection between the color selection means and the resistive layer. In tubes having an internal resistive layer, the resistance is determined mainly by the contact resistance between the contact spring and the resistive layer. The contact resistance is a result of the fact that the resistive layer consists of a mixture of electrically readily conductive and electrically poorly conductive particles. The contact resistance increases with decrease in the number of readily conductive particles of the resistive layer in contact with the contact spring. In accordance with the invention, the effective contact surface area between the resistive layer and the contact spring is enlarged, which results in a reduction of the contact resistance. In a practical case, in which the resistive layer has a resistance of approximately 1000 ohms per square, a contact resistance of approximately 5000 ohms was measured without the use of the invention. After the provision on the resistive layer of a low-ohmic contact face having an area of approximately 5 $cm^2$ and a resistance of approximately 25 ohms per square, the contact resistance was reduced by approximately a factor of 100. This resulted in a reduction of the interference radiation level by approximately 10 dB. Low-ohmic as used herein means that the electrical conductivity of the contact face is as large as possible and is preferably larger by at least a factor of 10 than that of the resistive layer. Possible tolerances in the location of a contact spring are compensated for by giving the low-ohmic contact face an area of at least 5 $cm^2$. A contact face in the form of a strip of low-ohmic material on the resistive layer has been found to be particularly advantageous. Due to its large area, the advantage of such a strip is that a good electrical coupling is obtained between the color selection means and the display screen and between the capacitor formed by the inner coating of the tube (the resistive layer) and the usual low-ohmic coating provided on the outside of the tube which is connected to the chassis of the television receiver. When more than one contact spring is used, the contact faces associated with the springs form one assembly with the above-mentioned strip. Strip and contact faces may consist of the same low-ohmic material so that they can be provided on the wall of the tube in one operation.

The invention will now be described in greater detail with reference to the drawing, in which.

Figure 1:
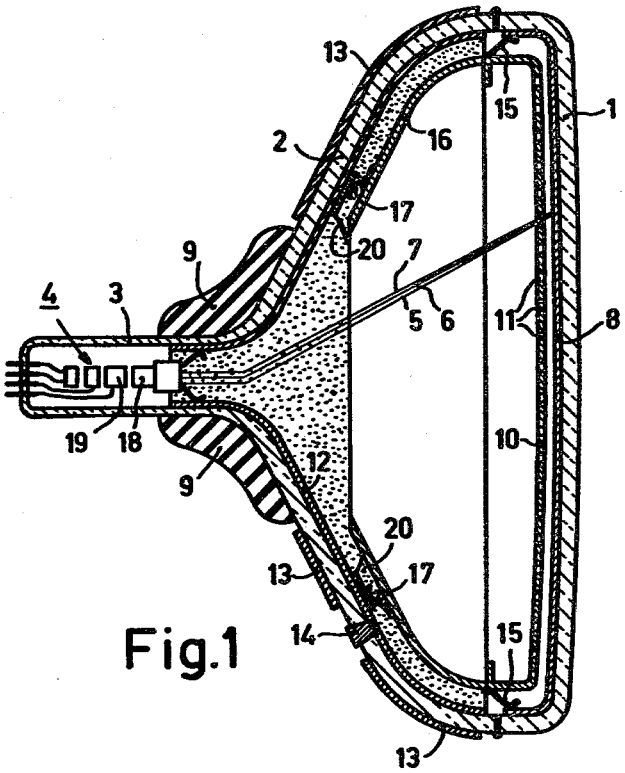
FIG. 1 is a sectional view of a color television display tube according to the invention.

The tube shown in a horizontal sectional view in FIG. 1 comprises a glass envelope consisting of a display window 1, a cone 2 and a neck 3. Positioned in the neck 3 is an electrode system 4 comprising three electron guns for generating three electron beams 5, 6 and 7. The electron beams are generated in one plane (here the plane of the drawing) and are directed onto a display screen 8 which is provided on the internal on surface of the display window 1. The display screen consists of a large number of phosphor strips coated with an aluminum layer and luminescing in red, green and blue. The longitudinal direction of the phosphor strips is normal to the plane through the electron guns (here the plane of the drawing). On their way to the display screen 8, the electron beams 5, 6 and 7 are deflected over the display screen 8 by a number of deflection coils 9 arranged coaxially around the tube axis. The beams then pass through a color selection electrode 10 consisting of a metal plate having elongate apertures 11 the longitudinal direction of which is parallel to the phosphor strips of the display screen 8. The three electron beams 5, 6 and 7 pass through the apertures 11 at a small angle with each other and consequently each impinges only upon phosphor strips of one color. The tube further comprises an internal resistive layer 12 and a readily conductive layer 13 provided on the outside of the cone 2. The resistive layer 12 has a thickness of approximately 10 microns and consists of 1 part by weight of graphite powder, 6 to 10 parts by weight of iron oxide powder ($Fe_2O_3$) and 1.5 to 3 parts by weight of an inorganic binder, for example potassium silicate or sodium silicate. The resistive layer 12 is connected to a high-voltage contact 14 provided in the cone of the tube. The color selection electrode 10 is connected to the display screen 8 by means of a number of contact springs 15. A metal screening cone 16 is connected on the one hand to the color selection electrode 10 and on the other hand to the resistive layer 12 by means of two contact springs 17. During operation of the tube, the layer 12 is at an operating potential of approximately 25 kV and the layer 13 is at mass potential because it is connected to the chassis of the receiver. The layers 12 and 13, with the glass of the cone therebetween as a dielectric, form a capacitor which serves as a smoothing capacitor for the high voltage. The capacitor discharges when an electrical flash-over occurs in the electrode system 4, for example, between the electrode 18 and the electrode 19 situated at a short distance therefrom. The value of the current pulse occurring during the discharge, however, is restricted by the resistive layer 12, in particular by the part thereof extending over the neck-cone transition and in the neck. The resistance represented by the resistive layer in dynamic conditions, that is during the electrical flash-over, generally is lower than in static conditions. Static conditions is to be understood to mean herein, the resistance defined as the quotient of a voltage difference of a few tens of volts set up across the consequent resistive layer and the current flowing through the resistive layer. For the above-given composition of the layer, the dynamic resistance is approximately 500 ohms and the static resistance is approximately 2000 ohms.

Figure 2:
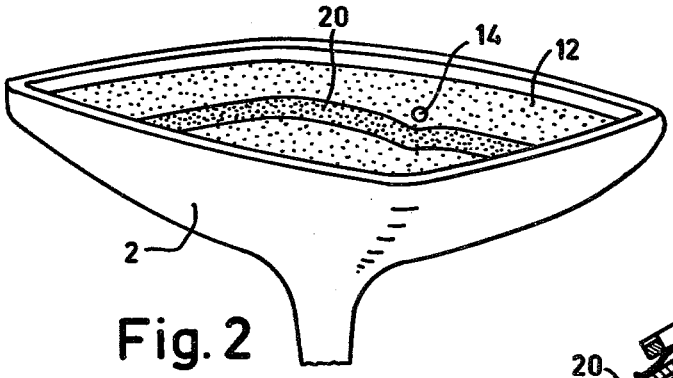
FIG. 2 shows the cone of the tube shown in FIG. 1 provided with an internal resistive layer.

The use of a resistive layer reduces the filtering effect of the tube with respect to the interference radiation it transmits. In this connection, the contact resistance between the contact springs 17 and the resistive layer 12 proves to be of particular importance in that the quantity of interference radiation decreases as the contact resistance is lowered. A low contact resistance is obtained by providing a low-ohmic contact face in the form of a strip 20 on the resistive layer 12 at the area where the contact springs 17 press against the wall of the tube. The strip 20 consists of a low-ohmic material having a composition of 60–90 parts by weight of graphite and 10–40 parts by weight of an inorganic binder, for example potassium silicate or sodium silicate. Such a material may be in the form of an aqueous suspension which is applied by a brush. Instead of this material, however, other good conductors may also be used, for example aluminum. The strip 20 has a width of approximately 5 cm and, as shown in FIG. 2, forms a closed ring on the inner surface of the cone 2. As a result of its large contact area, such as ring moreover provides a good electrical coupling between, on the one hand, the colour selection electrode 10 and the display screen 8 and, on the other hand, the capacitor formed by the resistive layer 12 and the external layer 13.

Figure 3:
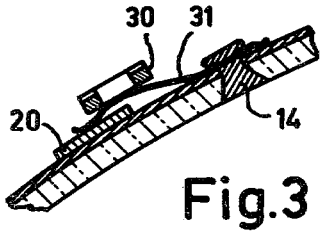
FIG. 3 shows a possible connection for a gettering device in a display tube shown in FIG. 1.

As is known, a layer of gettering material of, for example, barium, strontium, calcium or magnesium, is deposited on the wall of the tube after evacuating the tube to getter the residual gases in the tube. In a conventional display tube, the holder from which the gettering material is released by heating is connected to the electrode system either directly or by means of a metal strip. This conventional connection method cannot be used in a display tube of the invention because in the latter, a part of the gettering metal would be deposited on the resistive layer 12 at the area of the neck and the neck-cone transition and short circuit the resistive layer. Furthermore, in the case of an electrical flash-over, sliding sparks may occur along the connection strip of the holder. FIG. 3 shows an example of a possible connection of the getter holder in which these problems are avoided. In this example the gettering holder 30 is connected to the high voltage connecting 14 by means of a connection strip 31.

With such a construction the gettering material rather than being deposited on the neck and the neck-cone transition, is deposited on the wide part of the cone 2. Short-circuiting the resistive layer at this area improves the above-mentioned filtering effect of the tube while the dynamic resistance of the layer 12 is hardly influenced during an electrical flash-over.

The invention is not restricted to tubes having an internal metal screening cone. The invention may alternatively be used in tubes without a metal screening cone or in tubes having an external screening cone. In those cases, for example, the contact springs 17 are directly secured to the frame of the colour selection electrode 10 and the low-ohmic contact faces or strip 20 are situated farther in the direction towards the display screen than is shown in FIG. 1.

What is claimed is:

1. A color television display tube comprising an evacuated envelope, an electrode system disposed in said envelope for generating at least two electron beams, a display screen on an internal wall portion of said envelope, an electrically resistive layer for restricting currents produced during electric flash-overs provided on a portion of the internal wall of said envelope disposed between said electrode system and said display screen, a color selection means positioned in said envelope a predetermined distance from said screen, at least one metal contact spring disposed opposite said resistive layer, means for electrically connecting said spring to said color selections means, a contact face having an electrical conductivity at least ten times greater than the conductivity of said resistive layer and an area of at least 5 $cm^2$ applied on said resistive layer between said layer and said spring for reducing the contact resistance therebetween to thereby reduce electromagnetic interference radiation generated by the display tube and means arranged in said envelope for maintaining said spring in engagement with said contact face to thereby electrically connect said color selection means of said resistive layer.

2. A display tube according to claim 1 wherein said contact face is in the form of a strip.

3. A display tube according to claim 2 including at least two of said contact springs in contact with said strip.

4. A display tube according to claim 2 wherein said strip is in the form of an annulus extending about the inner wall of said envelope.

5. A display tube according to claim 1 wherein said resistive layer comprises one part by weight of graphite powder, 6 to 10 parts by weight of iron oxide powder and 1.5 to 3 parts by weight of alkali metal silicate, and wherein said contact face comprises 60 to 90 parts by weight of graphite powder and 10 to 40 parts by weight of alkali metal silicate.

* * * * *

UNITED STATES PATENT AND TRADEMARK OFFICE

CERTIFICATE OF CORRECTION

PATENT NO. : 4,188,564

DATED : February 12, 1980

INVENTOR(S) : Antonius P.F. Zegers e t al.

It is certified that error appears in the above—identified patent and that said Letters Patent is hereby corrected as shown below:

Column 5, line 9, after "means" delete "of" and insert -- to --.

Signed and Sealed this

*Sixth* Day of *January 1981*

[SEAL]

*Attest:*

SIDNEY A. DIAMOND

*Attesting Officer*

*Commissioner of Patents and Trademarks*